US007052819B2

(12) United States Patent
Simpson

(10) Patent No.: US 7,052,819 B2
(45) Date of Patent: May 30, 2006

(54) PHOTOTHERMOGRAPHIC MATERIALS WITH IMPROVED NATURAL AGE KEEPING

(75) Inventor: Sharon Mary Simpson, Lake Elmo, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/826,780

(22) Filed: Apr. 16, 2004

(65) Prior Publication Data

US 2005/0233270 A1 Oct. 20, 2005

(51) Int. Cl.
*G03C 5/16* (2006.01)
*G03C 1/00* (2006.01)

(52) U.S. Cl. ..... 430/139; 430/348; 430/350; 430/618; 430/619; 430/620; 430/617

(58) Field of Classification Search ..... 430/348, 430/350, 618, 619, 620, 139, 617
See application file for complete search history.

(56) References Cited

U.S. PATENT DOCUMENTS 4,510,236 A 4/1985 Gutman
6,297,002 B1 10/2001 Toya et al.
6,376,159 B1 * 4/2002 Strijckers ..... 430/350
6,440,649 B1 8/2002 Simpson et al.
6,573,033 B1 6/2003 Simpson et al.
6,762,013 B1 * 7/2004 Sakizadeh et al. ..... 430/350

FOREIGN PATENT DOCUMENTS

JP 62-215942 9/1987

OTHER PUBLICATIONS

U.S. Appl. No. 10/715,199 filed Nov. 17, 2003, titled "Stabilized High-Speed Thermally Developable Emulsions and Photothermographic Materials" by Karissa L. Eckert et al.
U.S. Appl. No. 10/826,500 (D-87067) filed on even date herewith, titled "Photothermographic Materials Containing Phosphors And Methods Of Using Same " by Simpson et al.

* cited by examiner

*Primary Examiner*—Geraldine Letscher
(74) *Attorney, Agent, or Firm*—J. Lanny Tucker; Louis M. Leichter

(57) ABSTRACT

The addition of certain aliphatic and non-aromatic carbocyclic polycarboxylic acids provides an improvement in natural age keeping properties of organic-solvent based photothermographic materials. This improvement is particularly useful in organic-based photothermographic materials containing phosphors in the photothermographic emulsion layer. Phosphor-containing materials can be particularly useful for direct radiographic imaging using X-radiation.

24 Claims, No Drawings

PHOTOTHERMOGRAPHIC MATERIALS WITH IMPROVED NATURAL AGE KEEPING

FIELD OF THE INVENTION

This invention relates to X-radiation sensitive photothermographic materials. In particular, this invention relates to organic-solvent based X-radiation sensitive photothermographic materials containing specific polycarboxylic acids to provide improved natural age keeping. This invention also relates to methods of imaging using these photothermographic materials.

BACKGROUND OF THE INVENTION

Silver-containing photothermographic imaging materials (that is, photosensitive thermally developable imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

Historically, photographic films containing various silver halides have been used for various radiographic purposes. Desired sensitivity to imaging X-radiation has been achieved through amplification of a relatively small number of latent image centers without too much "noise" being added to the image. However, such films require the use of undesirable aqueous processing solutions and equipment.

The term "noise" is understood in radiography to refer to the random variations in optical density throughout a radiographic image that impair the user's ability to distinguish objects within the image. Radiographic noise is considered to have a number of components identified in the art as described for example by Ter-Pogossian, *The Physical Aspects of Diagnostic Radiology*, Harper & Row, New York, Chapter 7, 1967.

Wet-processed radiographic films have generally been used in combination with metal plates or metal oxides that convert X-radiation to electrons, or inorganic phosphors that convert X-radiation to visible radiation. Such "converting" materials are also usually provided in a separate element in what is known as "metal screens", "intensifying screens", or "phosphor panels" because if phosphors or metal oxides are included within the typical silver halide emulsion, very high image noise levels result. Thus, metal or phosphor intensifying screens or panels have been commonly used in combination with radiographic films in what are known as cassettes or radiographic imaging assemblies.

Thus, attempts to incorporate phosphors in wet silver halide to improve sensitivity to X-radiation have been not been favored. K. Becker and coworkers found that incorporation of p-terphenyl into a wet silver halide emulsion gave a material with a flat energy response between 10 keV and 1000 keV but with an excessive amount of noise (K. Becker, E. Klein, and E. Zeitler, *Naturwissenschaften,* 1960, 47, 199, K. Becker, *Roentgenstr,* 1961 a, 95, 694, and K. Becker, *Roentgenstr,* 1961b, 95, 939).

U.S. Pat. No. 4,865,944 (Roberts et al.) describes "unitary" intensifying screen and radiographic elements in which layers of silver halide emulsion and phosphor-containing layers are coated adjacent to each other in conventional "wet" processed photographic materials.

Efforts have been made to increase photographic speed in photothermographic materials because such materials offer a number of important advantages over the use of conventional wet-processed photographic materials. Photographic speed can be increased in a number of ways including the use of various chemical sensitizing compounds; However, the use of such compounds may sometimes diminish the "natural age keeping" properties of the photothermographic materials, whereby $D_{min}$ tends to increase in unexposed areas over time.

In addition, because the level of silver halide is relatively low compared to wet-processed photographic materials, direct exposure of such materials to X-radiation would require that an undesirably high dosage be delivered to the film (through a patient) in order to produce a useful image.

One approach to reducing the amount of X-radiation exposure needed to produce an image in photothermographic materials is to place "double faced coatings" of photothermographic materials into contact with metal or phosphor intensifying screens [see for example JP Kokai 2001-109101 (Konica) and JP Kokai 2001-022027 (Konica)].

Advances in the art are provided with the X-radiation sensitive photothermographic materials described in U.S. Pat. No. 6,440,649 (Simpson et al.) and U.S. Pat. No. 6,573,033 (Simpson et al.) in which various phosphors are incorporated into imaging layers containing chemically sensitized silver halides.

However, there is a continuing need to find ways to improve the natural age keeping of solvent-based, high-speed X-radiation-sensitive photothermographic materials.

SUMMARY OF THE INVENTION

The present invention provides an organic solvent-based photothermographic material comprising a support having thereon, one or more imaging layers comprising a hydrophobic binder and:

a. a photosensitive silver halide, b. in reactive association with the photosensitive silver halide, a non-photosensitive source of reducible silver ions comprising a silver carboxylate, c. a reducing agent for the reducible silver ions comprising a phenolic developer, d. an aliphatic or non-aromatic carbocyclic polycarboxylic acid that is present in an amount of from about 0.0004 to about 0.01 mol/mol of total silver (or from about 0.0015 to about 0.0375 g/m$^2$), and e. optionally, an X-radiation-sensitive phosphor.

Preferred embodiments of the present invention include an organic solvent-based X-radiation sensitive photothermographic material that comprises a support having on one side thereof, a photothermographic imaging layer comprising a hydrophobic binder and in reactive association:

a. a photosensitive silver bromide or silver iodide, or mixture thereof, that has been chemically sensitized with a sulfur-containing chemical sensitizing compound, a tellurium-containing chemical sensitizing compound, or a gold(III)-containing chemical sensitizing compound, or mixtures of any of these chemical sensitizing agents, b. in reactive association with the photosensitive silver halide, a non-photosensitive source of reducible silver ions that comprises silver behenate, c. a reducing agent for the reducible silver ions that comprises a hindered phenol, d. one or more X-radiation-sensitive phosphors that are present in a total amount of from about 0.1 to about 20 mole per mole of total silver, the amount of total silver being from about 0.01 to about 0.05 mol/m$^2$, and e. one or more of citric acid, tartaric acid, maleic acid, fumaric acid, citraconic acid, mesaconic acid, tricarballylic acid, malonic acid, 1,2,3,4-butanetetracarboxylic acid, 1,2,3,4-cyclopentanetetracarboxylic acid, 1,3,5-cyclohexanetricarboxylic acid, and 1,2-cyclohexanedicarboxylic acid in an amount of from about 0.001 to about 0.004 mol/mol of total silver (or from about 0.004 to about 0.09 g/m$^2$).

This invention also provides a method for forming a visible image comprising:

A) imagewise exposing any of the photothermographic materials of the present invention to radiation to form a latent image, and B) simultaneously or sequentially, heating the exposed photothermographic material to develop the latent image into a visible image.

This imaging forming method is particularly useful for a dental diagnosis of a human or animal subject using direct exposure to X-radiation.

The addition of certain aliphatic and non-aromatic carbocyclic polycarboxylic acids has been found to provide an improvement in natural age keeping properties of organic-solvent based photothermographic materials. This improvement has been particularly observed for organic-based photothermographic materials containing phosphors in the photothermographic emulsion layer.

DETAILED DESCRIPTION OF THE INVENTION

The photothermographic materials of this invention can be used in black-and-white photothermography and in electronically generated black-and-white hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The photothermographic materials are particularly useful for medical imaging of human or animal subjects in response to visible or X-radiation for use in diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials of this invention may be used in combination with one or more phosphor intensifying screens. Such materials are particularly useful for dental radiography when they are directly imaged by X-radiation.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation greater than 100 nm (such as sensitivity to from about 100 to about 410 nm). Thus, they are sensitive to X-radiation directly through the use of phosphors in one or more imaging layers.

The photothermographic materials are also useful for non-medical uses of visible or X-radiation (such as X-ray lithography and industrial radiography).

In the photothermographic materials of this invention, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer. Various non-imaging layers are usually disposed on the "backside" (non-emulsion or non-imaging side) of the materials, including conductive layers, antihalation layers, protective layers, and transport enabling layers.

Various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some embodiments, it may be useful that the photothermographic materials be "double-sided" or "duplitized" and have the same or different photothermographic coatings (or imaging layers) on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the photothermographic materials are heat-developed as described below in a substantially water-free condition after, or simultaneously with, imagewise exposure, a silver image (preferably a black-and-white silver image) is obtained.

Definitions

As used herein:

In the descriptions of the photothermographic materials prepared by the present invention, "a" or "an" component refers to "at least one" of that component (for example, the specific polycarboxylic acids described herein).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising a support and at least one photothermographic emulsion layer or a photothermographic set of emulsion layers, wherein the photosensitive silver halide and the source of reducible silver ions are in one layer and the other components or additives are distributed, as desired, in the same layer or in an adjacent coated layer. These materials also include multilayer constructions in which one or more imaging components are in different layers, but are in "reactive association". For example, one layer can include the non-photosensitive source of reducible silver ions and another layer can include the reducing agent and/or photosensitive silver halide.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the reactive components are in the same layer or in adjacent layers so that they readily come into contact with each other during imaging and thermal development.

"Emulsion layer", "imaging layer", or "photothermographic emulsion layer" means a layer of a photothermographic material that contains the photosensitive silver halide (when used) and/or non-photosensitive source of reducible silver ions. Such layers can also contain additional components or desirable additives. These layers are usually on what is known as the "frontside" of the support, but they can also be on both sides of the support.

"Photocatalyst" means a photosensitive compound such as silver halide that, upon exposure to radiation, provides a compound that is capable of acting as a catalyst for the subsequent development of the image-forming material.

Many of the chemical components used herein are provided as a solution. The term "active ingredient" means the amount or the percentage of the desired chemical component contained in a sample. All amounts listed herein are the amount of active ingredient added.

"Ultraviolet region of the spectrum" refers to that region of the spectrum less than or equal to 410 nm (preferably from about 100 nm to about 410 nm) although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, contrast, Dmin, and Dmax have conventional definitions known in the imaging arts.

In photothermographic materials, the term Dmin is considered herein as image density achieved when the photothermographic material is thermally developed without prior exposure to radiation. It is the average of eight lowest density values on the exposed side of the fiducial mark. The term Dmax is the maximum image density achieved in the imaged area after imaging and development.

The sensitometric term absorbance is another term for optical density (OD).

"SP-2" (Speed-2) is Log1/E+4 corresponding to the density value of 1.00 above Dmin where E is the exposure in ergs/cm$^2$.

"AC-2" (Average Contrast-2) is the absolute value of the slope of the line joining the density points of 1.00 and 2.40 above Dmin.

"Transparent" means capable of transmitting visible light or imaging radiation without appreciable scattering or absorption.

As used herein, the phrase "silver organic coordinating ligand" refers to an organic molecule capable of forming a bond with a silver atom. Although the compounds so formed are technically silver coordination compounds they are also often referred to as silver salts.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mol % silver iodide.

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetrazaindene (such as 4-hydroxy-6-methyl-1,3,3a,7-tetrazaindene) or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

It is preferable to form the non-photosensitive source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the source of reducible silver ions in the presence of silver halide provides a more intimate mixture of the two materials [see U.S. Pat. No. 3,839,049 (Simons)] to provide a material often referred to as a "preformed soap".

Preformed silver halide grains may also be added to and physically mixed with the non-photosensitive source of reducible silver ions.

Preformed silver halide emulsions used in the material of this invention can be prepared by aqueous or organic processes and can be unwashed or washed to remove soluble salts. Soluble salts can be removed by any desired procedure for example as described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromosuccinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure*, June 1978, item 17029, U.S. Pat. No. 3,700,458 (Lindholm), U.S. Pat. No. 4,076,539 (Ikenoue et al.), JP Kokai 49-013224 (Fuji), JP Kokai 50-017216 (Fuji), and JP Kokai 51-042529 (Fuji).

The silver halide grains used in the imaging formulations can vary in average diameter of up to several micrometers (λm) depending on the desired use. Preferred silver halide grains are those having an average particle size of from about 0.01 to about 1.5 μm, more preferred are those having an average particle size of from about 0.03 to about 1.0 μm, and most preferred are those having an average particle size of from about 0.05 to about 0.8 μm.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described by in "Particle Size Analysis", ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides useful in the present invention can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP 0 915 371A1 (Lok et al.).

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold (3+)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes.

Other useful sulfur-containing chemical sensitizing compounds that can be decomposed in an oxidized environment are the diphenylphosphine sulfide compounds represented Structure (PS) described in copending and commonly assigned U.S. Ser. No. 10/731,251 (filed Dec. 9, 2003 by Simpson, Burleva, and Sakizadeh) which application is incorporated herein by reference.

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 μm.

Spectral Sensitization

The photosensitive silver halides used in the photothermographic materials of the invention may be spectrally sensitized with one or more spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP Kokai 2000-063690 (Tanaka et al.), JP Kokai 2000-112054 (Fukusaka et al.), JP Kokai 2000-273329 (Tanaka et al.), JP Kokai 2001-005145 (Arai), JP Kokai 2001-064527 (Oshiyama et al.), and JP Kokai 2001-154305 (Kita et al.), can be used in the practice of the invention. All of the publications noted above are incorporated herein by reference. Useful spectral sensitizing dyes are also described in *Research Disclosure*, December 1989, item 308119, Section IV and *Research Disclosure*, 1994, item 36544, section V.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Patent, U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.), JP Kokai 2001-109101 (Adachi), JP Kokai 2001-154305 (Kita et al.), and JP Kokai 2001-183770 (Hanyu et al.), all incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the photothermographic materials of this invention is a silver-organic compound that contains reducible silver (1+) ions. Such compounds are generally silver salts of silver organic coordinating ligands that are comparatively stable to light and form a silver image when heated to 50° C. or higher in the presence of an exposed silver halide and a reducing agent.

For the present invention, the primary organic silver salt is a silver carboxylate (described below) that comprises at least 70 mol % of all silver salts in the photothermographic material. Mixtures of silver carboxylates are particularly useful where the mixture includes at least silver behenate.

Useful silver carboxylates include silver salts of long-chain aliphatic or aromatic carboxylic acids (such as silver benzoates). The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Minor amounts (less than 30 mol % of total silver salts) of silver salts other than the silver carboxylates described above can be included if desired. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α- (on a hydrocarbon group) or ortho- (on an aromatic group) position as described in U.S. Pat. No. 5,491,059 (Whitcomb), silver salts of dicarboxylic acids silver salts of sulfonates as described in U.S. Pat. No. 4,504,575 (Lee), silver salts of sulfosuccinates as described in EP 0 227 141A1 (Leenders et al.), silver salts of acetylenes as described, for example in U.S. Pat. No. 4,761,361 (Ozaki et al.) and U.S. Pat. No. 4,775,613 (Hirai et al.), silver salts of heterocyclic compounds containing mercapto or thione groups and derivatives as described in U.S. Pat. No. 4,123,274 (Knight et al.) and U.S. Pat. No. 3,785,830 (Sullivan et al.), and silver salts of compounds containing an imino group such as silver salts of benzotriazole and substituted derivatives thereof.

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.) that is incorporated herein by reference, wherein a core has one or more silver salts and a shell has one or more different silver salts, as long as one of the silver salts is a silver carboxylate.

Other useful sources of non-photosensitive reducible silver ions are the silver dimer compounds that comprise two different silver salts as described in U.S. Pat. No. 6,472,131 (Whitcomb) that is incorporated herein by reference.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Published Application 2004-0023164 (Bokhonov et al.) that is incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively, the amount of the sources of reducible silver ions is generally from about 0.001 to about 0.2 mol/$m^2$ of the dry photothermographic material (preferably from about 0.01 to about 0.05 mol/$m^2$).

The total amount of silver (from all silver sources) in the photothermographic materials is generally at least 0.002 mol/m and preferably from about 0.01 to about 0.05 mol/$m^2$.

Reducing Agents

The reducing agent (or reducing agent composition comprising two or more components) for the source of reducible silver ions can be any material (preferably an organic material) that can reduce silver (1+) ion to metallic silver. The "reducing agent" is sometimes called a "developer" or "developing agent".

Conventional phenolic developers can be used as the primary reducing agents, including aromatic di- and trihydroxy compounds, aminophenols, alkoxynaphthols, polyhydroxy spiro-bis-indanes, hydroxytetrone acids, hydroxytetronimides, hindered phenols, and other materials readily apparent to one skilled in the art.

One or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl) methanes (that is bisphenols), hindered phenols, and hindered naphthols, each of which may be variously substituted. U.S. Pat. No. 3,094,417 (Workman) and U.S. Pat. No. 5,262,295 (Tanaka et al.), both incorporated herein by reference, describe useful hindered phenols, including 1,1'-bis(2-hydroxy-3,5-dimethylphenyl)-3,5,5-trimethylhexane (NONOX® or PERMANAX® WSO) and 2,2'-isobutylidene-bis(4,6-dimethylphenol) (LOWINOX® 221B46).

Still another useful class of reducing agents includes polyhydroxy spiro-bis-indane compounds described as photographic tanning agents in U.S. Pat. No. 3,440,049 (Moede).

While the phenolic developers comprise at least 70 mol % of the total reducing agents in the photothermographic materials, minor amounts of additional non-phenolic reducing agents may be present if desired. Such reducing agents include ascorbic acid reducing agents. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described in U.S. Pat. No. 5,498,511 (Yamashita et al.), EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure*, item 37152, March 1995. Mixtures of these developing agents can be used if desired.

An additional class of reducing agents that can be used in minor amounts are substituted hydrazines including the sulfonyl hydrazides described in U.S. Pat. No. 5,464,738 (Lynch et al.). Still other useful reducing agents are described in U.S. Pat. No. 3,074,809 (Owen), U.S. Pat. No. 3,094,417 (Workman), U.S. Pat. No. 3,080,254 (Grant, Jr.), U.S. Pat. No. 3,887,417 (Klein et al.), and U.S. Pat. No. 5,981,151 (Leenders et al.). All of these patents are incorporated herein by reference.

Additional reducing agents that may be used in minor amounts include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.) that is incorporated herein by reference. Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference. Yet another class of co-developers includes substituted acrylonitrile compounds such as the compounds identified as HET-01 and HET-02 in U.S. Pat. No. 5,635,339 (Murray) and CN-01 through CN-13 in U.S. Pat. No. 5,545,515 (Murray et al.).

Various contrast enhancing agents can be used in some photothermographic materials with specific co-developers. Examples of useful contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

Aromatic di- and tri-hydroxy reducing agents can also be used in combination with hindered phenol reducing agents and further in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Phosphors

Phosphors are materials that emit infrared, visible, or ultraviolet radiation upon excitation. The phosphors useful in this invention are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures, in the practice of this invention. More specific details of useful phosphors are provided as follows. For example, useful phosphors are described in numerous references relating to fluorescent intensifying screens including *Research Disclosure*, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocom), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP 0 491,116A1 (Benzo et al.), the disclosures of all of which are incorporated herein by reference with respect to the phosphors.

Useful classes of phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Preferred rare earth oxychalcogenide and oxyhalide phosphors are represented by the following Structure (I):

$$M'_{(w-n)}M''_nO_wX' \quad \text{(I)}$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), O is oxygen, X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides such as $Gd_2O_2S$:Tb.

Other suitable phosphors are described in U.S. Pat. No. 4,835,397 (Arakawa et al.) and U.S. Pat. No. 5,381,015 (Dooms), both incorporated herein by reference, and including for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another useful class of phosphors are those that include an alkaline earth containing host and a rare earth, such as europium, and are rare earth activated mixed alkaline earth metal sulfates such as europium-activated barium strontium sulfate.

Particularly useful phosphors are those containing doped or undoped tantalum such as $YTaO_4$, $YTaO_4$:Nb, Y(Sr)$TaO_4$, and Y(Sr)$TaO_4$:Nb. These phosphors are described in U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), all incorporated herein by reference.

Other useful phosphors are alkaline earth metal phosphors that can be the products of firing starting materials comprising optional oxide and a combination of species characterized by the following Structure (II):

$$MFX_{1-z-2u}M^aX^a{:}yA{:}eQ{:}tD \quad \text{(II)}$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$,:$Nb_2O_5$, $Ta_2O_5$, or $ThO_2$, "D" is vanadium (V), chromium (Cr), manganese (Mn), iron (Fe), cobalt (Co), or nickel (Ni). The numbers in Structure II are the following: "z" is 0 to 1, "u" is from 0 to 1, "y" is from $1\times10^{-4}$ to 0.1, "e" is from 0 to 1, and "t" is from 0 to 0.01. These definitions apply wherever they are found in this application unless specifically stated to the contrary. It is also contemplated that "M", "X", "A", and "D" represent multiple elements in the groups identified above.

Storage phosphors can also be used in the practice of this invention. Various storage phosphors are described for example, in U.S. Pat. No. 5,464,568 (noted above), incorporated herein by reference. Such phosphors include divalent alkaline earth metal fluorohalide phosphors that may contain iodide are the product of firing an intermediate, comprising oxide and a combination of species characterized by the following Structure (III):

$$(Ba_{1-a-b-c}Mg_aCa_bSr_c)FX_{1-z}I_zrM^aX^a:yA \quad \text{(III)}$$

wherein X, $M^a$, $X^a$, A, z, and y have the same meanings as for Structure (II) and the sum of a, b, and c is from 0 to 4, and r is from $10^{-6}$ to 01. Some embodiments of these phosphors are described in more detail in U.S. Pat. No. 5,464,568 (noted above).

Still other storage phosphors are described in U.S. Pat. No. 4,368,390 (Takahashi et al.), incorporated herein by reference, and include divalent europium and other rare earth activated alkaline earth metal halides and rare earth element activated rare earth oxyhalides, as described in more detail above.

Examples of useful phosphors include: SrS:Ce,SM, SrS:Eu,Sm, $ThO_2$:Er, $La_2O_2S$:Eu,Sm, ZnS:Cu,Pb, and others described in U.S. Pat. No. 5,227,253 (Takasu et al.), incorporated herein by reference.

Some particularly useful phosphors are primarily "activated" phosphors known as phosphate phosphors and borate phosphors. Examples of these phosphors are rare earth phosphates, yttrium phosphates, strontium phosphates, or strontium fluoroborates. Preferably, the phosphors are cerium activated rare earth or yttrium phosphates, or europium activated strontium fluoroborates.

In addition, the rare earth phosphate phosphors of this type preferably have a zircon or monazite crystal structure. Phosphors with a monazite crystal structure are most preferred.

In some embodiments of this invention, the phosphors are europium activated strontium fluoroborates having a composition defined from the following Structure (IV):

$$M_aF_bB_cO_d:eEu \quad \text{(IV)}$$

wherein M is strontium, or a mixture of metals containing strontium and one or more of the metals Mg or Ca, F is fluoride, B is boron, O is oxygen, $0<a\leqq1.5$, $0<b\leqq0.5$, $2<c\leqq5$, $3<d\leqq7$, $0<e\leqq0.25$, and $0<a+e\leqq2$.

The preparation of compounds of Structure (IV) are described in U.S. Pat. No. 3,431,215 (Chenot), JP 50-092281 (Westinghouse Electric Corp., USA), and by K. H. Butler in "*Fluorescent Lamp Phosphors*", The Pennsylvania State University Press, University Park, Pa., 1980, Chapt. 4, pp. 49–60.

In other embodiments, the phosphors are strontium phosphates having a composition defined by the following Structure (V) as said X-radiation-sensitive phosphor:

$$M^1_{a1}M^2_{b1}M^3_{c1}P_{d1}O_{e1} \quad \text{(V)}$$

wherein $M^1$ and $M^2$ are different metals selected from the group consisting of Mg, Ca, Sr, and Zn, $M^3$ is one or more of the metals Eu, Mn, Sn, and Pb, $0<a1\leqq2$, $0<b1\leqq1$, $0<c1\leqq0.2$, $0<a1+b1+c1\leqq2$, $0<d1\leqq4$, and $0<e1\leqq10$.

The preparation of compounds of Structure (V) are described for example, by Butler in "*Fluorescent Lamp Phosphors*" (noted above) and by M. V. Hoffman, *J. Electrochem. Soc.,* 1968, 115 (5), 560–563.

In still other embodiments, the phosphors are cerium and strontium activated and co-activated rare earth phosphates or cerium and strontium activated yttrium phosphates such as those defined by the following Structure (VI) as said X-radiation-sensitive phosphor:

$$M^1_{a2}M^2_{b2}M^3_{c2}M^4_{d2}P_{e2}O_f \quad \text{(VI)}$$

wherein $M^1$ is lanthanum or yttrium, $M^2$ is cerium, $M^3$ is gadolinium, ytterbium, or a mixture thereof, $M^4$ is strontium or a strontium containing a mixture of alkaline earth metals, $0<a2\leqq1$, $0<b2\leqq0.6$, $0<c2\leqq0.5$, $0<d2\leqq0.1$, $0<a2+b2+c2+d2\leqq(e2+1)$, and $0<f\leqq(4.5e2)$.

Of the phosphors defined by Structure (VI), the most preferred phosphors have a monazite crystal structure and a composition that is defined by the following Structure (VII):

$$M^1_{a2}M^2_{b2}M^4_{d2}P_{e2}O_f \quad \text{(VII)}$$

wherein $M^1$ is lanthanum, $M^2$ is cerium, $M^4$ is strontium or a strontium containing a mixture of alkaline earth metals, $0.5<a2\leqq1$, $0.005<b2\leqq0.3$, $0<c3\leqq0.1$, $0<a2+b2+d2\leqq(e2+1)$, and $(3.5e2)<f\leqq(4.5e2)$.

The preparation of compounds of Structures (VI) and (VII) are described for example, in U.S. Pat. No. 3,104,226 (Struck), JP 01-126390 (Okada et al.) and Butler, "*Fluorescent Lamp Phosphors*", The Pennsylvania State University Press, University Park, Pa., 1980, Chapter 4, pp. 49–60, Chapter 14 pp. 167–169, and Chapter 16, pp. 258–286. The crystal structures of preferred phosphors defined by structures (VI) and structure (VII) are given in A. T. Aldred, *Acta Cryst.,* 1984, B40, 569–574.

Useful phosphors of these types can be obtained from a number of commercial sources including Nichia Corporation of America (Mountville, Pa.) and Osram Sylvania (Towanda, Pa.).

The one or more phosphors used in the practice of this invention are present in the photothermographic materials in an amount of at least 0.1 mole per mole, and preferably from about 0.5 to about 20 mole, per mole of total silver in the photothermographic material. As noted above, generally, the amount of total silver is at least 0.002 mol/$m^2$.

While the phosphors can be incorporated into any imaging layer on one or both sides of the support, it is preferred that they be in the same layer(s) as the photosensitive silver halide(s) on one or both sides of the support. Because of the size of the phosphors used in the invention, generally the layers in which they are incorporated (usually one or more emulsion layers) have a dry coating weight of phosphor of at least 5 g/$m^2$, and preferably from about 5 g/$m^2$ to about 200 g/$m^2$. Preferably, the one or more phosphors, the photosensitive silver halide, the non-photosensitive source of reducible silver ions, and the binder are incorporated within the same imaging layer that has a dry coating weight of from about 100 g/$m^2$ to about 800 g/$m^2$. Most preferably the imaging layer has a dry coating weight of between 300 to 400 g/$m^2$.

Polycarboxylic Acids

The one or more polycarboxylic acids used in the practice of the present invention to improve natural age keeping of the photothermographic materials are aliphatic or non-aromatic carbocyclic compounds having at least two carboxylic acid groups. Thus, aromatic carbocyclic polycarboxylic acids are excluded from use in this invention. Preferably, the useful polycarboxylic acids have three or more carboxylic acid groups in each molecule.

It is preferred that the photothermographic materials of this invention include one or more polycarboxylic acid compounds that are represented by the following Structure (VIII):

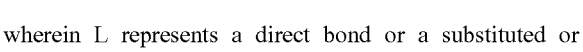

HOOC—L—COOH (VIII)

wherein L represents a direct bond or a substituted or unsubstituted aliphatic linking group consisting of 1 or 2 carbon atoms (that is, substituted or unsubstituted methylene or ethylene groups).

In Structure (VIII), when L represents a substituted aliphatic group consisting of 1 or 2 carbons directly linking the two carboxy groups, L can be substituted with one or more carboxy groups (—COOH), alkylcarboxy groups having 1 to 6 carbon atoms in the alkyl moiety [such as methylcarboxy (—$COOCH_3$)], hydroxy groups, carboxyalkyl groups having 1 to 3 carbon atoms in the alkyl moiety [such as carboxymethyl (—$CH_2COOH$) or carboxyethyl (—$CH_2CH_2COOH$)], alkyl groups having 1 to 4 carbon atoms such as methyl, ethyl iso-propyl, n-butyl, and t-butyl) or two alkyl groups on the same carbon may be connected to form a 3- to 6-membered cycloalkyl ring (such as cyclopropyl or cyclobutyl), alkenyl groups having 2 to 4 carbon atoms (such as vinyl, allyl and propenyl), 5- to 6-membered cycloalkyl (such as cyclopentyl or cyclohexyl). All of these substituents can be further substituted, as one skilled in the art would readily appreciate.

In some preferred embodiments, L represents a substituted or unsubstituted aliphatic chain consisting of 2 carbon atoms in the chain (such as an ethylene group). In more preferred embodiments, at least one of those two carbon atoms is substituted with a hydroxy, carboxy, or carboxyalkyl group as defined above. In such more preferred embodiments, L is particularly —$CH_2$—C(OH)($CH_2COOH$)—.

Representative compounds having Structure (VIII) that are useful as stabilizers in the practice of this invention include but are not limited to the following listed compounds (and mixtures thereof):

Allylmalonic acid, 1,2,3,4-butanetetracarboxylic acid, 3-butene-1,2,3-tricarboxylic acid, butyl malonic acid, D-(−)-citramalic acid, L-(+)-citramalic acid, citric acid, 1,1-cyclobutanedicarboxylic acid, 1,1-cyclopropanedicarboxylic acid, dihydroxymalonic acid, dimethylmalonic acid, 1,1,2-ethanetricarboxylic acid, homoisocitric acid, hydroxycitric acid, 2-hydroxy-2-isopropylsuccinic acid, 1-indanylmalonic acid, isocitric acid, ketomalonic acid monohydrate, D-malic acid, L-malic acid, D,L-malic acid, maleic acid, fumaric acid, citraconic acid, mesoconic acid, malonic acid, meso-tartaric acid, meso-tartaric acid monohydrate, D,L-2-methylcitric acid, methylmalonic acid, 2-methylpropane-tricarboxylic acid, D,L-methyltartronic acid, oxalic acid, succinic acid, D-(−)-tartaric acid, L-(+i)-tartaric acid, D,L-tartaric acid, D,L-tartaric acid hydrate, tartronic acid, D,L-threo-3-isopropylmalic acid, and tricarballylic acid.

Some particularly useful polycarboxylic acids are citric acid, tartaric acid, maleic acid, fumaric acid, citraconic acid, mesaconic acid, malonic acid, succinic acid, oxalic acid, malonic acid, malic acid, tricarballylic acid, 1,2,3,4-butanetetracarboxylic acid, 1,2,3,4-cyclopentane tetracarboxylic acid, 1,3,5-cyclohexanetricarboxylic acid, and 1,2-cyclohexanedicarboxylic acid. Mixtures of these compounds can also be used.

Citric acid, tricarballylic acid, 1,2,3,4-butanetetracarboxylic acid, 1,2,3,4-cyclopentane tetracarboxylic acid, tartaric acid, succinic acid, oxalic acid, malonic acid, malic acid, butyl malonic acid, and mixtures thereof, are more preferred.

Citric acid, tricarballylic acid, 1,2,3,4-butanetetracarboxylic acid, 1,2,3,4-cyclopentane tetracarboxylic acid, and mixtures thereof are most preferred.

These compounds are available from commercial sources or can be prepared by methods known in the art.

The one or more polycarboxylic acids are present in an amount of from about 0.0004 to about 0.01 mol/mol of total silver, and preferably in an amount of from about 0.001 to about 0.004 mol/mol of total silver. In many embodiments, the general amount can correspond to from about 0.0015 to about 0.0375 $g/m^2$ and the preferred amount can correspond to from about 0.004 to about 0.09 $g/m^2$.

While the compounds of Structure (VIII) can be incorporated into any imaging layer on one or both sides of the support, it is preferred that they be in the same layer(s) as the photosensitive silver halide(s) on one or both sides of the support.

Other Addenda

The photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, Dmin, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Useful heteroaromatic mercapto compounds are described as supersensitizers for infrared photothermographic materials in EP 0 559 228B1 (Philip Jr. et al.).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

A heteroaromatic mercapto compound is generally present in an emulsion layer in an amount of at least 0.0001 mole (preferably from about 0.001 to about 1.0 mole) per mole of total silver in the emulsion layer.

The photothermographic materials can be further protected against the production of fog and can be stabilized against loss of sensitivity during storage. Suitable antifoggants and stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287, 135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) may be useful as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, Jr. et al.), diisocyanate compounds as described in EP 0 600 586A1 (Philip, Jr. et al.), and tribromomethylketones as described in EP 0 600 587A1 (Oliff et al.).

Preferably, the photothermographic materials include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants are polyhalo antifoggants, such as those having a —$SO_2C(X')_3$ group wherein X' represents the same or different halogen atoms.

The photothermographic materials of this invention may also include one or more thermal solvents (or melt formers) such as disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials. Representative base-release agents or base precursors include guanidinium compounds and other compounds that are known to release a base but do not adversely affect photographic silver halide materials (such as phenylsulfonyl acetates) as described in U.S. Pat. No. 4,123,274 (Knight et al.).

The use of "toners" or derivatives thereof that improve the image are highly desirable components of the photothermographic materials. Toners (also known as "toning agents") are compounds that when added to the photothermographic imaging layer(s) shift the color of the developed silver image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer(s) or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Phthalazine and phthalazine derivatives [such as those described in U.S. Pat. No. 6,146,822 (Asanuma et al.), incorporated herein by reference], phthalazinone, and phthalazinone derivatives are particularly useful toners.

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No. 6,713,240 (Lynch et al.), and U.S. Published Application 2004-0013984 (Lynch et al), all of which are incorporated herein by reference.

Also useful are the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al) all of which are incorporated herein by reference.

The photothermographic materials of this invention can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al), and GB 1,565,043 (Fuji Photo). All of these patents and patent applications are incorporated herein by reference.

Binders

The chemically sensitized photosensitive silver halide, the non-photosensitive source of reducible silver ions, the reducing agent, phosphor, and any other imaging layer additives used in the present invention are generally combined with one or more binders that are generally hydrophobic in nature. Thus, organic solvent-based formulations can be used to prepare the photothermographic materials of this invention. Mixtures of binders can also be used.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available under the names BUTVAR® (Solutia, Inc.) and PIOLOFORM® (Wacker Chemical Company).

Minor amounts (less than 30 weight % of total binders) of hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.).

Where the proportions and activities of the photothermographic materials require a particular developing time and temperature, the binder(s) should be able to withstand those conditions. It is preferred that the binder (or mixture thereof) does not decompose or lose its structural integrity at 120° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer.

Support Materials

The photothermographic materials prepared by this invention comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters (such as polyethylene terephthalate and polyethylene naphthalate), cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use supports comprising dichroic mirror layers as described in U.S. Pat. No. 5,795,708 (Boutet), incorporated herein by reference.

Also useful are transparent, multilayer, polymeric supports comprising numerous alternating layers of at least two different polymeric materials as described in U.S. Pat. No. 6,630,283 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Photothermographic Formulations

An organic solvent-based coating formulation for the photothermographic emulsion layer(s) can be prepared by mixing the various components with one or more hydrophobic binders in a suitable organic solvent system that usually includes one or more organic solvents, such as toluene, 2-butanone (methyl ethyl ketone), acetone, or tetrahydrofuran, or mixtures thereof.

Photothermographic materials prepared by this invention can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The photothermographic materials of this invention can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al). All of the above patents and patent applications are incorporated herein by reference.

Still other conductive compositions include fluorochemicals that are reaction products of $R_f$—$CH_2CH_2$—$SO_3H$ with amines wherein $R_f$ comprises 4 or more fully fluorinated carbon atoms as described in U.S. Pat. No. 6,699,648 (Sakizadeh et al.) that is incorporated herein by reference.

Additional conductive compositions include one or more fluoro-chemicals described in U.S. Pat. No. 6,762,013 (Sakizadeh et al.) that is incorporated herein by reference.

Layers to promote adhesion of one layer to another in photothermographic materials are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), and U.S. Pat. No. 6,667,148 (Rao et al.), and in U.S. Pat. No. 6,746,831 (Hunt), all incorporated herein by reference.

The photothermographic formulations described herein (including the photothermographic emulsion formulation) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Subsequently to or simultaneously with application of the photothermographic emulsion formulation to the support, a protective overcoat formulation can be applied over the emulsion formulation.

Preferably, two or more layer formulations are applied simultaneously to a film support using slide coating, the first layer being coated on top of the second layer while the second layer is still wet. The first and second fluids used to coat these layers can be the same or different solvents.

In other embodiments, a "carrier" layer formulation comprising a single-phase mixture of the two or more polymers described above may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the photothermographic emulsion layer formulation.

Mottle and other surface anomalies can be reduced in the photothermographic materials by incorporation of a fluorinated polymer as described in U.S. Pat. No. 5,532,121 (Yonkoski et al.) or by using particular drying techniques as described, for example in U.S. Pat. No. 5,621,983 (Ludemann et al.).

While the layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

It is also contemplated that the photothermographic materials of this invention can include photothermographic emulsion layers on both sides of the support and/or an antihalation underlayer beneath at least one emulsion layer.

To promote image sharpness, photothermographic materials of the present invention can contain one or more layers containing acutance and/or antihalation dyes. These dyes are chosen to have absorption close to the exposure wavelength and are designed to absorb scattered light. One or more antihalation compositions may be incorporated into one or more antihalation backing layers, underlayers, or overcoats. Additionally, one or more acutance dyes may be incorporated into one or more frontside layers.

Dyes useful as antihalation and acutance dyes include squaraine dyes as described in U.S. Pat. No. 5,380,635 (Gomez et al.), U.S. Pat. No. 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.), all incorporated herein by reference.

It is also useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), JP Kokai 2001-142175 (Hanyu et al.), and JP Kokai 2001-183770 (Hanye et al.). Useful bleaching compositions are also described in JP Kokai 11-302550 (Fujiwara), JP Kokai 2001-109101 (Adachi), JP Kokai 2001-51371 (Yabuki et al.), and JP Kokai 2000-029168 (Noro). All of the noted publications are incorporated herein by reference.

Other useful heat-bleachable backside antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

In some embodiments, the photothermographic materials of this invention include a surface protective layer over one or more imaging layers on one or both sides of the support. In other embodiments, the photothermographic materials include a surface protective layer on the same side of the support as the one or more photothermographic emulsion layers and a layer on the backside that includes an antihalation and/or conductive antistatic composition. A separate backside surface protective layer can also be included in these embodiments.

Imaging/Development

The photothermographic materials of the present invention can be imaged in any suitable manner consistent with the type of material using any suitable imaging source (typically X-radiation). Other embodiments may be sensitive to radiation in the range of from about at least 100 nm to about 1400 nm.

Imaging can be achieved by exposing the X-radiation photothermographic materials of this invention to a suitable source of X-radiation to provide a latent image. Suitable exposure means are well known and include sources of X-radiation including medical, mammography, dental, and industrial X-ray units.

Thermal development conditions will vary, depending on the construction used but will typically involve heating the imagewise exposed material at a suitably elevated temperature, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means. A preferred heat-development procedure includes heating at from about 110° C. to about 135° C. for from about 3 to about 25 seconds.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

Use as a Photomask

The photothermographic materials described herein can be sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material.

Thus, in some other embodiments wherein the photothermographic material comprises a transparent support, the image-forming method further comprises, after steps A and B noted above:

(C) positioning the exposed and heat-developed photothermographic material between a source of imaging radiation and an imageable material that is sensitive to the imaging radiation, and (D) exposing the imageable material to the imaging radiation through the visible image in the exposed and heat-developed photothermographic material to provide an image in the imageable material.

Imaging Assemblies

The photothermographic materials of this invention are also useful in an imaging assembly comprising one or more phosphor intensifying screens adjacent the front and/or back of the photothermographic material. Such screens are well known in the art [for example, U.S. Pat. No. 4,865,944 (Roberts et al.) and U.S. Pat. No. 5,021,327 (Bunch et al.)]. An assembly (often known as a cassette) can be prepared by arranging the photothermographic material and the one or more screens in a suitable holder and appropriately packaging them.

A phosphor intensifying screen can be positioned in "front" of the photothermographic material to absorb X-radiation and to emit electromagnetic radiation having a wavelength greater than 100 nm and to which the photothermographic material has been sensitized. Duplitized X-radiation sensitive photothermographic materials are preferably used in combination with two intensifying screens, one screen in the "front" and one screen in the "back" of the material.

The following examples are provided to illustrate the practice of the present invention and the invention is not meant to be limited thereby.

Materials and Methods for the Experiments and Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID® A-21 is an acrylic copolymer available from Rohm and Haas (Philadelphia, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co. (Kingsport, Tenn.).

The Fischer X-Ray machine was a Model 36600G and was obtained from Fischer Imaging Corporation (Denver, Colo.).

DESMODUR N3300 is an aliphatic hexamethylene diisocyanate that is available from Bayer Chemicals (Pittsburgh, Pa.).

PERMANAX® WSO (or NONOX®) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

PHP is pyridinium hydrobromide perbromide.

Vinyl Sulfone-1 is described in U.S. Pat. No. 6,143,487 (noted above) and is believed to have the following structure (VS-1).

(VS-1)

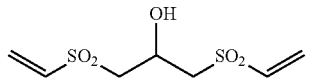

Antifoggant AF-A is tribromomethylsulfonylpyridine and is believed to have the following structure (AF-A).

(AF-A)

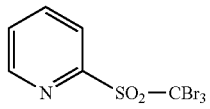

Antifoggant AF-B is described in U.S. Pat. No. 5,686,228 (noted above) and is believed to have the following structure (AF-B).

(AF-B)

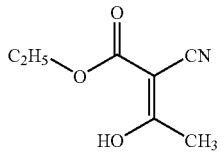

Compound CN-08 is described in U.S. Pat. No. 5,545,515 (noted above) and is believed to have the following structure.

(CN-08)

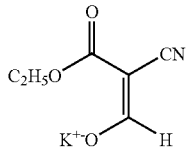

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the following structure.

(BC-1)

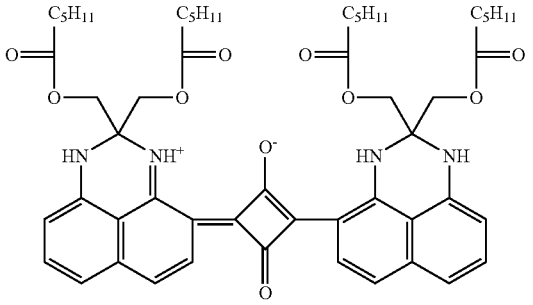

Compounds S-1 and S-2 are sulfur-containing chemical sensitizers. Compound Au-1 is a gold(III)-containing chemical sensitizer. The structures of these compounds are shown below.

(S-1)

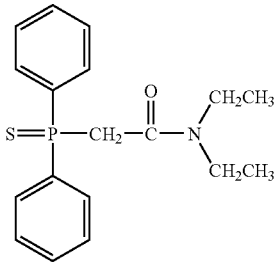

(S-2)

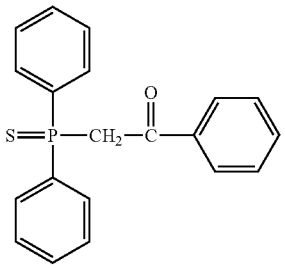

(Au-1)

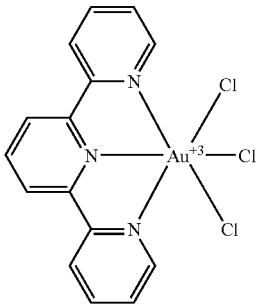

The following examples demonstrate the improvement upon storage under ambient conditions [also known as natural age keeping (NAK)] for both phosphor and non-phosphor containing photothermographic materials upon addition of carboxylic acids. Different size silver halide grains and different sulfur-containing chemical sensitizers were studied in various formulations with these carboxylic acid compounds.

Coating, Exposure, and Processing Conditions Photothermographic emulsion and topcoat formulations were coated under safelight conditions using a dual knife coating machine onto a 7 mil (178 μm) blue-tinted polyethylene terephthalate support provided with a backside antihalation layer containing Dye BC-1 in CAB 171-15S resin binder. Samples were dried for 7 minutes at 87° C. The silver coating weights were approximately 2.25 to 2.28 g/m$^2$.

The resulting photothermographic films were cut into strip samples and imagewise exposed for $10^{-2}$ seconds using a conventional EG&G Mark VII flash sensitometer equipped with a continuous density wedge having an optical density of from 0.0 to 4.0, a P-16 filter and a 0.7 neutral density filter. Following exposure, the films were developed using a heated roll processor for 15 seconds at 122.2° C. to 122.8° C. to generate continuous density "wedges" varying from a minimum density ($D_{min}$) to a maximum density ($D_{max}$).

Densitometry measurements were made on a custom built computer-scanned densitometer and meeting ISO Standards 5-2 and 5-3. They are believed to be comparable to measurements from commercially available densitometers. Density of the wedges was measured using a filter appropriate to the sensitivity of the photothermographic material to obtain graphs of density versus log exposure (that is, D log E curves).

EXAMPLE 1

Use of Citric Acid in Photothermographic Materials Having 0.14 μm Silver Halide Grains A photothermographic formulation was prepared as follows:

A preformed silver bromoiodide (94% Br/6% I), silver carboxylate "soap" comprising silver behenate was prepared as described in U.S. Pat. No. 6,413,710 (Shor et al.). The average grain size was 0.14 μm. The photothermographic emulsions were chemically sensitized according to procedures described in U.S. Pat. No. 6,423,481 (Simpson et al.) using the materials and amounts shown below. "CA-1" is citric acid.

Photothermographic Emulsion Formulation

To 193.8 g of this silver soap dispersion at 23.9% solids was added in order:

| Compound | Amount | Mix Time | Temp. |
|---|---|---|---|
| S-1 | 8.2 ml of a solution of 0.0508 g in 8.64 g of MeOH | 40 min | 67° F. (19.4° C.) |
| Zinc Bromide | 0.169 g in 1.19 g of MeOH | 30 min | |
| PHP | 0.20 g in 1.58 g of MeOH | 60 min | |
| Cool to | | 10 min | 61° F. (16.1° C.) |
| Au-1 | 4.8 ml of a solution of 0.0052 g in 50 g of MeOH | 60 min | |

-continued

| Compound | Amount | Mix Time | Temp. |
|---|---|---|---|
| Chlorobenzoyl benzoic acid | 1.42 g | 15 min | |
| Cool to | | 20 min | 50° F. (10° C.) |
| BUTVAR ® B-79 | 20 g | 30 min | |
| Antifoggant-A | 2.14 g in 24.2 g of MEK | 10 min | |
| Desmodur N3300 | 0.63 g in 1.5 g of MEK | | |
| Phthalazine | 1.0 g in 5 g of MEK | 15 min | |
| Tetra-chlorophthalic acid | 0.35 g in 2 g of MEK | | |
| 4-Methylphthalic acid | 0.45 g in 4 g of MEK | 15 min | |
| PERMANAX ® WSO | 10.6 g | 15 min | |

Protective Topcoat Formulation

A protective topcoat formulation for the photothermographic emulsion layers was prepared as follows:

| | |
|---|---|
| ACRYLO1D ® A-21 | 0.58 g |
| CAB 171-15S | 14.9 g |
| MEK | 183.4 g |
| VS-1 | 0.3 g |
| Benzotriazole | 1.6 g |
| Antifoggant-B | 0.12 g |

A coating formulation was prepared as described above, by adding 0.5 ml of a solution of 0.035 g of CA-1 in 3.5 g methanol to a 25 g aliquot of the emulsion formulation. A control coating formulation was prepared without addition of CA-1.

Photothermographic and protective topcoat formulations were simultaneously coated using an automated dual-knife coater. Formulations were coated and dried to achieve similar silver coating weights. Samples were exposed, imaged and developed as described above.

The initial sensitometric results, shown below in TABLE I demonstrate that similar initial Dmin, speed, and contrast when citric acid (CA-1) is formulated in a photothermographic emulsion formulation.

Samples of each of these materials were stored in the dark at ambient temperature and humidity for 3 months. These samples were then imaged and their sensitometry was measured. The changes in Dmin, SP-2, and AC-1 after 3 months, shown below in TABLE I, demonstrate that the photothermographic material containing citric acid (CA-1) showed a 35% reduction in the increase of Dmin upon aging.

TABLE I

| | Acid | Initial Sensitometry | | | Change in Sensitometry after 3 Months | | |
|---|---|---|---|---|---|---|---|
| Example | Used | Dmin | SP-2 | AC-1 | ΔDmin | ΔSP-2 | ΔAC-1 |
| 1-1 Control | None | 0.26 | 3.57 | 3.02 | +0.06 | +0.18 | −0.92 |
| 1-2 Invention | CA-1 | 0.26 | 3.55 | 3.02 | +0.04 | +0.14 | −0.95 |

EXAMPLE 2

Use of Citric Acid in Photothermographic Materials Having 0.20 μm Silver Halide Grains A preformed silver bromoiodide (98% Br/2% I), silver carboxylate "soap" comprising silver behenate was prepared as described in U.S. Pat. No. 6,413,710 (Shor et al.). The average grain size was 0.20 am. The photothermographic emulsions were chemically sensitized according to procedures described in U.S. Pat. No. 6,423,481 (Simpson et al.) but incorporating 6.0 ml of a solution of 0.0526 g of sulfur sensitizer S-2 in 8.82 g methanol in place of sulfur sensitizer S-1. The amounts of other materials were the same as described in Example 1.

A coating formulation was prepared as described in Example 1 by adding 0.5 ml of a solution of 0.035 g of CA-1 (citric acid) in 3.5 g methanol to a 25 g aliquot of the emulsion formulation. A control coating formulation was prepared without addition of CA-1.

Photothermographic and protective topcoat formulations were simultaneously coated using an automated dual-knife coater. Formulations were coated and dried to achieve similar silver coating weights. Samples were exposed, imaged and developed as described above.

The initial sensitometric results, shown below in TABLE II demonstrate an improvement in Dmin when citric acid (CA-1) is formulated in a photothermographic emulsion. Speed and contrast were unaffected.

Samples of these materials were stored in the dark at ambient temperature and humidity for 3 months and the sensitometry was again measured. The changes in Dmin, SP-2, and AC-1 after 3 months, shown below in TABLE II, demonstrate that photothermographic materials containing citric acid (CA-1) showed a 50% reduction in the increase of Dmin upon aging.

TABLE II

| | Acid | Initial Sensitometry | | | Change in Sensitometry after 3 Months | | |
|---|---|---|---|---|---|---|---|
| Example | Used | Dmin | SP-2 | AC-1 | ΔDmin | ΔSP-2 | ΔAC-1 |
| 2-1 Control | None | 0.44 | 4.00 | 2.58 | +0.53 | +0.10 | −1.42 |
| 2-2 Invention | CA-1 | 0.40 | 3.95 | 2.43 | +0.27 | +0.14 | −1.27 |

EXAMPLE 3

Use of Citric Acid in Phosphor-Containing Photothermographic Materials

Photothermographic emulsion formulations were prepared as described in Example 1 incorporating either sulfur sensitizer S-1, or 6.0 ml of solution containing 0.0537 g of sulfur sensitizer S-2, in 9.0 g of methanol. Formulations were prepared by adding 0.5 ml of a solution of 0.035 g of citric acid (CA-1), in 3.5 g methanol to a 25 g aliquot of the emulsion formulation. Control coating formulations were also prepared but without addition of compound CA-1. Mixing for 5 minutes was followed by addition of 18.2 g of $YSrTaO_4$ phosphor having an average particle size of 4 μm.

The formulations were mixed for an additional 5 minutes. The formulations were coated, dried, imaged, and developed as described in Example 1. Phosphor coating weights were approximately 76 to 81 g/m 2. The formulations were coated to achieve similar silver coating weights. Samples were exposed, imaged and developed as described above.

The initial sensitometric results, shown below in TABLE III, demonstrate similar Dmin, speed, and contrast when citric acid is formulated along with a standard emulsion formulation.

Samples of these materials were stored in the dark at ambient temperature and humidity for 3 months and the sensitometry was again measured. The changes in Dmin, SP-2, and AC-2 after 3 months, shown below in TABLE III, demonstrate that phosphor-containing photothermographic material formulated with citric acid show a reduction in the increase of Dmin upon aging.

TABLE III

| | Sulfur | Acid | Initial Sensitometry | | | Change in Sensitometry after 3 Months | | |
|---|---|---|---|---|---|---|---|---|
| Example | Sensitizer | Used | Dmin | SP-2 | AC-1 | ΔDmin | ΔSP-2 | ΔAC-2 |
| 3-1 Control | S-1 | None | 0.81 | 4.20 | 4.47 | +0.34 | +0.04 | −0.64 |
| 3-2 Invention | S-1 | CA-1 | 0.81 | 4.16 | 4.53 | +0.09 | +0.10 | −0.91 |
| 3-3 Control | S-2 | None | 0.85 | 4.20 | 4.35 | +0.33 | +0.11 | −0.16 |
| 3-4 Invention | S-2 | CA-1 | 0.83 | 4.14 | 4.55 | +0.13 | +0.13 | −0.27 |

EXAMPLE 4

Use of Citric Acid in Phosphor-Containing High-Contrast Photothermographic Materials Photothermographic emulsion formulations were prepared as described in Example 2. To 25 g aliquots of photothermographic emulsion was added 0.5 ml of a solution prepared by dissolving 0.055 g of acrylonitrile high-contrast agent (compound CN-8) in 0.947 g of methanol and 0.5 ml of a solution of 0.035 g of citric acid (CA-1) in 3.5 g methanol. A control coating formulation was also prepared but without addition of CA-1. Mixing for 5 minutes was followed by addition of 18.2 g of $YsrTaO_4$ phosphor having an average particle size of 4 μm. The formulations were coated, dried, imaged, and developed as described in Example 1. Phosphor coating weights were approximately 76 to 81 g/$m^2$. The formulations were coated to achieve similar silver coating weights. Samples were exposed, imaged and developed as described above.

The initial sensitometric results, shown below in TABLE IV, demonstrate similar speed, and contrast when citric acid is used in a photothermographic emulsion. A decrease in Dmin was also found.

Samples of these materials were stored in the dark at ambient temperature and humidity for 3 months and the sensitometry was again measured. The changes in Dmin, SP-2, and AC2 after 3 months, shown below in TABLE IV, demonstrate that the phosphor-containing photothermographic materials formulated with both a high-contrast compound and citric acid show a 15% reduction in the increase of Dmin upon aging.

TABLE IV

| | Acid | Initial Sensitometry | | | Change in Sensitometry after 3 Months | | |
|---|---|---|---|---|---|---|---|
| Example | Used | Dmin | SP-2 | AC-2 | ΔDmin | ΔSP-2 | ΔAC-2 |
| 4-1 Control | None | 0.73 | 4.18 | 2.69 | +0.36 | −0.19 | +3.25 |
| 4-2 Invention | CA-1 | 0.69 | 4.12 | 2.62 | +0.30 | −0.39 | +2.67 |

EXAMPLE 5

Use of Other Polycarboxylic Acids in Phosphor-Containing Photothermographic Materials A preformed silver bromoiodide (98% Br/2% 1), silver carboxylate "soap" comprising silver behenate was prepared as described in U.S. Pat. No. 6,413,710 (Shor et al.). The average grain size was 0.15 μm. The photothermographic emulsions were chemically sensitized according to procedures described in U.S. Pat. No. 6,423,481 (Simpson et al.) using the materials and amounts shown below.

Photothermographic Emulsion Formulation

To 163.0 g of this silver soap dispersion at 28.37% solids was added in order:

| Compound | Amount | Mix Time | Temp. |
|---|---|---|---|
| MEK | 21.3 g | 15 min | 67° F. (19.4° C.) |
| Zinc Bromide | 0.169 g in 1.19 g of MeOH | 30 min | |
| S-1 | 8.1 ml of a solution of 0.0508 g in 8.64 g of MeOH | 45 min | |
| PHP | 0.20 g in 1.58 g of MeOH | 60 min | |
| Cool | | 10 min | 61° F. (16.1° C.) |
| Au-1 | 4.8 ml of a solution of 0.0052 g in 50 g of MeOH | 60 min | |
| Chlorobenzoyl benzoic acid | 1.42 g | 15 min | |
| Cool | | 20 min | 50° F. (10° C.) |
| BUTVAR ® B-79 | 20 g | 30 min | |
| Antifoggant-A | 1.71 g in 19.4 g of MEK | 10 min | |
| Desmodur N3300 | 0.63 g in 1.5 g of MEK | | |
| Phthalazine | 1.0 g in 5 g of MEK | 15 min | |
| Tetra-chlorophthalic acid | 0.35 g in 2 g of MEK | | |
| 4-Methylphthalic acid | 0.45 g in 4 g of MEK | 15 min | |
| PERMANAX ® WSO | 10.6 g | 15 min | |

Protective Topcoat Formulation

Two protective topcoat formulations for the photothermographic emulsion layer was prepared as follows:

| Protective Topcoat Formulation I | |
|---|---|
| ACRYLOID ® A-21 | 0.58 g |
| CAB 171-15S | 14.9 g |
| MEK | 183.4 g |
| VS-1 | 0.3 g |
| Benzotriazole | 1.6 g |
| Antifoggant-B | 0.12 g |
| **Protective Topcoat Formulation II** | |
| ACRYLOID ® A-21 | 0.58 g |
| CAB 171-15S | 14.9 g |
| MEK | 183.4 g |
| VS-1 | 0.3 g |
| Benzotriazole | 1.6 g |
| Antifoggant-A | 0.85 g |
| Antifoggant-B | 0.12 g |

To 25 g aliquots of the emulsion formulation was added 0.38 ml of a solution of $1.64\times10^{-4}$ moles of either citric acid (CA-1), tricarballylic acid (TCA-1), or malonic acid (MA-1) in 2.0 g MEK and 0.63 g MEOH. Mixing for 5 minutes was followed by addition of 18.2 g of $YSrTaO_4$ phosphor having an average size of 4 am. The formulations were mixed for an additional 5 minutes.

Photothermographic materials were prepared using two protective topcoat formulations. Photothermographic and protective topcoat formulations were simultaneously coated using an automated dual-knife coater. The formulations were coated and dried as described in Example 1. Phosphor coating weights were approximately 73 to 77 g/m$^2$. The formulations were coated to achieve similar silver coating weights. Samples were exposed, imaged and developed as described above.

The initial sensitometric results, shown below in TABLE V, demonstrate that addition of carboxylic acid compounds to photothermographic emulsions provides photothermographic materials having similar speed. Initial Dmin was considerably decreased by addition of the acid compounds. A decrease in contrast was also noticed, however this decrease was similar to that observed by use of Protective Topcoat II.

Samples of these materials were stored in the dark at ambient temperature and humidity for 3 months and the sensitometry was again measured. The changes in Dmin, SP-2, and AC-2 after months, shown below in TABLE V demonstrate that the phosphor-containing photothermographic materials containing these acid compounds show a reduction in the increase of Dmin upon aging. The greatest improvements were observed with citric acid (55%) and tricarballylic acid (65%).

TABLE V

| | Acid | Topcoat | Initial Sensitometry | | | Change in Sensitometry after 3 Months | | |
|---|---|---|---|---|---|---|---|---|
| Example | Used | Used | Dmin | SP-2 | AC-2 | ΔDmin | ΔSP-2 | ΔAC-2 |
| 5-1 Control | None | I | 1.14 | 4.16 | 4.50 | +0.65 | +0.16 | −0.97 |
| 5-2 Control | None | II | 1.01 | 4.26 | 3.85 | +0.57 | +0.02 | −0.95 |
| 5-3 Invention | CA-1 | I | 0.94 | 4.21 | 4.06 | +0.29 | +0.02 | −0.53 |
| 5-4 Invention | TCA-1 | I | 0.85 | 4.12 | 3.86 | +0.23 | +0.04 | −0.30 |
| 5-5 Invention | MA-1 | I | 0.85 | 4.14 | 3.89 | +0.54 | −0.02 | −0.57 |

EXAMPLE 6

Use of Citric Acid in Phosphor-Containing Photothermographic Materials

To 25 g aliquots of photothermographic emulsion formulation prepared as described in Example 5 was added 0.35 ml of a solution of $1.64\times10^{-4}$ moles of citric acid (CA-1) in 2.0 g MEK and 0.63 g MEOH. Mixing for 5 minutes was followed by addition of 18.2 g of $YSrTaO_4$ phosphor having an average size of 4 μm. The formulations were mixed for an additional 5 minutes.

Photothermographic materials were again prepared using two protective topcoat formulations. Photothermographic and protective topcoat formulations were simultaneously coated using an automated dual-knife coater. The formulations were coated and dried as described in Example 1. Phosphor coating weights were approximately 74 to 78 g/m$^2$. The formulations were coated to achieve similar silver coating weights. Samples were exposed, imaged and developed as described above.

The initial sensitometric results, shown below in TABLE VI, demonstrate that addition of citric acids to photothermographic emulsions provides photothermographic materi als having decreased Dmin. Some loss in speed and contrast was found. This decrease was similar to that observed by use of Protective Topcoat II.

Samples of these materials were stored in the dark at ambient temperature and humidity for 3 months, and the sensitometry was again measured. The changes in Dmin, SP-2, and AC-2 after 3 months, shown below in TABLE VI, demonstrate that the phosphor-containing photothermographic materials containing citric acid show a reduction in the increase of Dmin upon aging.

TABLE VI

| | Acid | Topcoat | Initial Sensitometry | | | Change in Sensitometry after 3 Months | | |
|---|---|---|---|---|---|---|---|---|
| Example | Used | Used | Dmin | SP-2 | AC-2 | ΔDmin | ΔSP-2 | ΔAC-2 |
| 6-1 Control | None | I | 1.06 | 4.26 | 4.15 | +0.36 | +0.04 | −0.40 |
| 6-2 Control | None | II | 1.00 | 4.17 | 3.84 | +0.30 | −0.03 | −0.76 |
| 6-3 Invention | CA-1 | I | 0.96 | 4.13 | 3.88 | +0.19 | −0.03 | −0.51 |

The X-ray sensitometric response of these photothermographic materials with and without CA-1 was determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.05 sec to 1.5 sec was made. After exposure, samples were developed in a manner similar as described in Example 1.

The density of these samples were measured with an X-rite 310 densitometer using the Status A filters and measured with the visible filter. The sensitometric results, as measured by the difference between Developed Density and Dmin, shown below in TABLE VII, demonstrate similar sensitivity to X-rays when citric acid is incorporated into a phosphor-containing photothermographic material.

TABLE VII

| Example | Acid Used | (Developed Density − Dmin) at 0.2 sec | (Developed Density − Dmin) at 0.4 sec |
|---|---|---|---|
| 6-1 Control | None | 0.34 | 1.01 |
| 6-3 Invention | CA-1 | 0.38 | 0.96 |

EXAMPLE 7

Use of Other Polycarboxylic Acids in Phosphor-Containing Photothermographic Materials To 25 g aliquots of photothermographic emulsion formulation prepared as described in Example 5, were added 0.35 ml of a solution of $1.64\times10^{-4}$ moles of 1,3,5-cyclohexanetricarboxylic acid (CHTA-1), 1,2,3,4-butanetetracarboxylic acid (BTCA-1), fumaric acid (FA-1), maleic acid (MLA-1), mesaconic acid (MSA-1), citraconic acid (CTA-1) or 1,2-cyclohexanedicarboxylic acid (CHDA-1) in 2.0 g MEK and 0.63 g MEOH. The formulations were coated, dried, imaged, and developed as described in Example 1. Phosphor coating weights were approximately 73 to 85 g/m$^2$. The formulations were coated to similar achieve silver coating weights.

The initial sensitometric results, shown below in TABLE VIII, demonstrate that photothermographic emulsions incorporating carboxylic acids provide photothermographic materials with similar speed and contrast. An increase in Dmin was observed with CHTA-1, MSA-1, and CHDA-1.

Samples of these materials were stored in the dark at ambient temperature and humidity for 3 months and the sensitometry was again measured. The changes in Dmin, SP-2, and AC-2 after 3 months, shown below in TABLE VIII, demonstrate that phosphor-containing photothermographic materials formulated with these acid compounds show a 10% to 70% reduction in the increase of Dmin upon aging. The greatest improvement was observed with 1,2,3,4-butanetetracarboxylic acid.

TABLE VIII

| | Acid | Topcoat | Initial Sensitometry | | | Change in Sensitometry after 3 Months | | |
|---|---|---|---|---|---|---|---|---|
| Example | Used | Used | Dmin | SP-2 | AC-2 | ΔDmin | ΔSP-2 | ΔAC-2 |
| 7-1 Control | None | I | 1.06 | 4.26 | 4.15 | +0.36 | +0.04 | −0.40 |
| 7-2 Control | None | II | 1.09 | 4.28 | 3.99 | +0.35 | +0.00 | −0.57 |
| 7-3 Invention | CHTA-1 | I | 1.16 | 4.26 | 4.02 | +0.25 | +0.06 | −0.42 |
| 7-4 Invention | BTCA-1 | I | 1.02 | 4.16 | 4.11 | +0.10 | +0.09 | −0.22 |
| 7-5 Invention | FA-1 | I | 1.06 | 4.23 | 4.09 | +0.29 | +0.08 | −0.59 |
| 7-6 Invention | MLA-1 | I | 1.06 | 4.22 | 4.03 | +0.25 | +0.09 | −0.40 |
| 7-7 Invention | MSA-1 | I | 1.11 | 4.23 | 4.06 | +0.27 | +0.10 | −0.49 |
| 7-8 Invention | CTA-1 | I | 1.07 | 4.20 | 4.09 | +0.29 | +0.10 | −0.54 |
| 7-9 Invention | CHDA-1 | I | 1.15 | 4.21 | 4.13 | +0.32 | +0.09 | −0.51 |

EXAMPLE 8

Use of Other Polycarboxylic Acids in Phosphor-Containing Photothermographic Materials To 25 g aliquots of photothermographic emulsion prepared as described in Example 5, were added 0.35 ml of a solution of $1.64\times10^{-4}$ moles of either 1,2,3,4-cyclopentanetetracarboxylic acid (CPTA-1) or tartaric acid (TA-1) in 2.0 g MEK and 0.63 g MEOH. The formulations were coated, dried, imaged, and developed as described in Example 5. Phosphor coating weights were approximately 74 to 78 $g/m^2$. The formulations were coated to achieve similar silver coating weights.

The initial sensitometric results, shown below in TABLE IX, demonstrate that photothermographic emulsions incorporating carboxylic acids provide photothermographic materials with similar Dmin, speed and AC-2 to that of a photothermographic material not incorporating these acids.

Samples of these materials were stored in the dark at ambient temperature and humidity for 3 months, and the sensitometry was again measured. The changes in Dmin, SP-2, and AC-2 after 3 months, shown below in TABLE IX, demonstrate that phosphor-containing photothermographic material containing 1,2,3,4-cyclopentanetetracarboxylic acid showed a 60% reduction in the increase Dmin upon aging.

TABLE IX

| | Acid | Topcoat | Initial Sensitometry | | | Change in Sensitometry after 3 Months | | |
|---|---|---|---|---|---|---|---|---|
| Example | Used | Used | Dmin | SP-2 | AC-2 | ΔDmin | ΔSP-2 | ΔAC-2 |
| 8-1 Control | None | I | 1.15 | 4.16 | 4.50 | +0.65 | +0.16 | −0.98 |
| 8-2 Control | None | II | 1.08 | 4.13 | 4.70 | +0.62 | +0.20 | −1.74 |
| 8-3 Invention | CPTA-1 | I | 1.01 | 4.10 | 4.59 | +0.26 | +0.18 | −0.70 |
| 8-4 Invention | TA-1 | I | 1.17 | 4.11 | 4.52 | +0.55 | +0.18 | −0.95 |

EXAMPLE 9

Use of Other Polycarboxylic Acids in Phosphor-Containing Photothermographic Materials To 25 g aliquots of photothermographic emulsion prepared as described in Example 5, were added 0.35 ml of a solution of $1.64\times10^{-4}$ moles of 1,2,3,4,5,6-cyclohexanehexacarboxylic acid (CHHA-1) or 1,3,5-pentanetricarboxylic acid (PTA-1) in 2.0 g MEK and 0.63 g MEOH. The formulations were coated, dried, imaged, and developed in a manner similar to that described in Example 5. Phosphor coating weights were from 74 to 78 $g/m^2$. The formulations were coated to achieve similar silver coating weights.

The initial sensitometric results, shown below in TABLE X, demonstrate that photothermographic emulsions incorporating carboxylic acids provide photothermographic materials with similar Dmin and AC-2 to that of a photothermographic material not incorporating these acids. Some loss of speed was found.

Samples of these materials were stored in the dark at ambient temperature and humidity for 3 months, and the sensitometry was again measured. The changes in Dmin, SP-2, and AC-2 after 3 months, shown below in TABLE X, demonstrate that the phosphor-containing photothermographic materials containing 1,2,3,4,5,6-cyclohexanehexacarboxylic acid (CHHA-1) showed a 27% improvement in Dmin aging. Photothermographic materials containing 1,3,5-pentanetricarboxylic acid (PTA-1) showed a 10%. reduction in the increase of Dmin upon aging.

TABLE X

| | Acid | Topcoat | Initial Sensitometry | | | Change in Sensitometry after 3 Months | | |
|---|---|---|---|---|---|---|---|---|
| Example | Used | Used | Dmin | SP-2 | AC-2 | ΔDmin | ΔSP-2 | ΔAC-2 |
| 9-1 Control | None | I | 1.47 | 4.18 | 3.75 | +0.49 | +0.06 | −0.85 |
| 9-2 Control | None | II | 1.46 | 4.18 | 3.89 | +0.47 | +0.04 | −1.16 |
| 9-3 Invention | CHAA-1 | I | 1.50 | 4.13 | 3.83 | +0.36 | +0.06 | −0.74 |
| 9-4 Invention | PTA-1 | I | 1.48 | 4.10 | 3.70 | +0.44 | +0.08 | −0.54 |

The invention has been described in detail with particular reference to certain preferred embodiments thereof, but it will be understood that variations and modifications can be effected within the spirit and scope of the invention.

What is claimed is:

1. An organic solvent-based photothermographic material comprising a support having thereon, one or more imaging layers comprising a hydrophobic binder and:

a. a photosensitive silver halide, b. in reactive association with said photosensitive silver halide, a non-photosensitive source of reducible silver ions, c. a reducing agent for said reducible silver ions, e. an aliphatic or non-aromatic carbocyclic polycarboxylic acid that is present in an amount of from about 0.0004 to about 0.01 mol/mol of total silver, and, d. optionally, an X-radiation-sensitive phosphor.

2. The material of claim 1 wherein said aliphatic or non-aromatic carbocyclic polycarboxylic acid is represented by the following Structure (VIII):

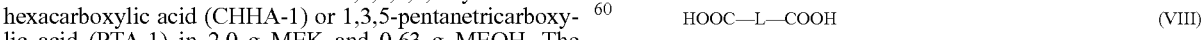

HOOC—L—COOH (VIII)

wherein L represents a direct bond or a substituted or unsubstituted aliphatic linking group consisting of 1 or 2 carbon atoms.

3. The material of claim 1 wherein said aliphatic or non-aromatic carbocyclic polycarboxylic acid has three or more carboxylic acid groups.

4. The material of claim 1 wherein said aliphatic or non-aromatic carbocyclic polycarboxylic acid is one or more of citric acid, tartaric acid, maleic acid, fumaric acid, succinic acid, oxalic acid, malonic acid, malic acid, citraconic acid, mesaconic acid, malonic acid, tricarballylic acid, 1,2,3,4-butanetetracarboxylic acid, 1,2,3,4-cyclopentanetetracarboxylic acid, 1,3,5-cyclohexanetricarboxylic acid, and 1,2-cyclohexanedicarboxylic acid.

5. The material of claim 4 wherein said aliphatic or non-aromatic carbocyclic polycarboxylic acid is citric acid, tricarballylic acid, 1,2,3,4-butanetetracarboxylic acid, 1,2,3,4-cyclopentanetetracarboxylic acid, and mixtures of these.

6. The material of claim 1 wherein the total silver coverage is at least 0.002 mol/$m^2$ and said aliphatic or non-aromatic carbocyclic polycarboxylic acid is present in an amount of from about 0.001 to about 0.004 mol/mol of total silver.

7. The material of claim 1 comprising a cerium activated rare earth phosphate or a cerium activated yttrium phosphate as said X-radiation-sensitive phosphor, said X-radiation-sensitive phosphor having a zircon or monazite crystal structure.

8. The material of claim 1 comprising a europium activated strontium fluoroborate having a composition defined from the following Structure (IV) as said X-radiation-sensitive phosphor:

$$M_aF_bB_cO_d{:}eEu \quad (IV)$$

wherein M is strontium, or a mixture of metals containing strontium and one or more of the metals Mg or Ca, F is fluoride, B is boron, 0 is oxygen, $0<a\leqq1.5$, $0<b\leqq0.5$, $2<c\leqq5$, $3<d\leqq7$, $0<e\leqq0.25$, and $0<a+e\leqq2$.

9. The material of claim 1 comprising a strontium phosphate having a composition defined by the following Structure (V) as said X-radiation-sensitive phosphor:

$$M^1_{a1}M^2_{b1}M^3_{c1}P_{d1}O_{e1} \quad (V)$$

wherein $M^1$ and $M^2$ are different metals selected from the group consisting of Mg, Ca, Sr, and Zn, $M^3$ is one or more of the metals Eu, Mn, Sn, and Pb, $0<a1\leqq2$, $0<b1\leqq1$, $0<c1\leqq0.2$, $0<a1+b1+c1\leqq2$, $0<d1\leqq4$, and $0<e1\leqq10$.

10. The material of claim 1 comprising a cerium and strontium activated rare earth phosphate or a cerium and strontium activated yttrium phosphate having a composition defined by the following Structure (VI) as said X-radiation-sensitive phosphor:

$$M^1_{a2}M^2_{b2}M^3_{c2}M^4_{d2}P_{e2}O_f \quad (VI)$$

wherein $M^1$ is lanthanum or yttrium, $M^2$ is cerium, $M^3$ is gadolinium, ytterbium, or a mixture thereof, $M^4$ is strontium or a strontium containing a mixture of alkaline earth metals, $0<a2\leqq1$, $0<b2\leqq0.6$, $0<c2\leqq0.5$, $0<d2\leqq0.1$, $0<a2+b2+c2+d2\leqq(e2+1)$, and $0<f\leqq(4.5e2)$.

11. The material of claim 1 wherein said phosphor is calcium tungstate ($CaWO_4$), a niobium and/or rare earth activated or unactivated yttrium, lutetium, or gadolinium tantalates, a rare earth-activated or unactivated middle chalcogen phosphor, or a terbium-activated or unactivated lanthanum and lutetium middle chalcogen phosphor.

12. The material of claim 11 wherein said phosphor is a rare earth oxychalcogenide and halide phosphor represented by the following Structure (I):

$$M'_{(w-n)}M''_nO_wX' \quad (I)$$

wherein M' is at least one of the metals yttrium (Y), lanthanum (La), gadolinium (Gd), or lutetium (Lm), M" is at least one of the rare earth metals dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), 0 is oxygen, X' is a middle chalcogen (S, Se, or Te) or halogen, n is 0.002 to 0.2, and w is 1 when X' is halogen or 2 when X' is a middle chalcogen.

13. The material of claim 11 wherein said phosphor is the product of firing starting materials comprising optional oxide and a combination of species characterized by the following Structure (II):

$$MFX_{1-z}L_zuM^aX^a{:}yA{:}eQ{:}tD \quad (II)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni), "z" is 0 to 1, "u" is from 0 to 1, "y" is from $1\times10^{-4}$ to 0.1, "e" is from 0 to 1, and "t" is from 0 to 0.01.

14. The material of claim 11 wherein said phosphor is a divalent alkaline earth metal fluorohalide phosphors characterized by the following Structure (III):

$$(Ba_{1-a-b-c}Mg_aCa_bSr_c)FX_{1-z}L_zrM^aX^a{:}yA \quad (III)$$

wherein "M" is magnesium (Mg), calcium (Ca), strontium (Sr), or barium (Ba), "F" is fluoride, "X" is chloride (Cl) or bromide (Br), "I" is iodide, Ma is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "z" is 0 to 1, "y" is from $1\times10^{-4}$ to 0.1, the sum of a, b and c is from 0 to 4, and r is from $10^{-6}$ to 0.1.

15. The material of claim 1 wherein said photosensitive silver halide and said X-radiation-sensitive phosphor are in the same imaging layer.

16. The material of claim 1 comprising the same or a different imaging layer(s) on both sides of said support.

17. The material of claim 1 wherein said photosensitive silver halide has been chemically sensitized with a sulfur-containing chemical sensitizing compound, a tellurium-containing chemical sensitizing compound, or a gold(III)-containing chemical sensitizing compound, or mixtures of any of these chemical sensitizing agents.

18. An organic solvent-based X-radiation sensitive photothermographic material that comprises a support having on one side thereof, a photothermographic imaging layer comprising a hydrophobic binder and in reactive association:

a. a photosensitive silver bromide or silver iodide, or mixture thereof, that has been chemically sensitized with a sulfur-containing chemical sensitizing compound, a tellurium-containing chemical sensitizing compound, or a gold(III)-containing chemical sensitizing compound, or mixtures of any of these chemical sensitizing agents, b. in reactive association with said photosensitive silver halide, a non-photosensitive source of reducible silver ions comprises silver behenate, c. a reducing agent for said reducible silver ions that comprises a hindered phenol, d. one or more X-radiation-sensitive phosphors that are present in a total amount of from about 0.1 to about 20 mole per mole of total silver, the amount of total silver being from about 0.01 to about 0.05 mol/$m^2$, and e. one or more of citric acid, tartaric acid, maleic acid, fumaric acid, citraconic acid, mesaconic acid, malonic acid, tricarballylic acid, 1,2,3,4-butanetetracarboxylic acid, 1,2,3,4-cyclopentanetetracarboxylic acid, 1,3,5-cyclohexanetricarboxylic acid, and 1,2-cyclohexanedicarboxylic acid in an amount of from about 0.001 to about 0.004 mol/mol of total silver.

19. The material of claim 18 comprising citric acid, tricarballylic acid, 1,2,3,4-butanetetracarboxylic acid, 1,2,3,4-cyclopentanetetracarboxylic acid, or a mixture of these.

20. The material of claim 18 having the same or different imaging layer(s) on both sides of said support.

21. A method for forming a visible image comprising:

A) imagewise exposing any of the photothermographic materials of claim 1 to radiation to form a latent image, and B) simultaneously or sequentially, heating the exposed photothermographic material to develop the latent image into a visible image.

22. The method of claim 21 for providing a radiographic image of a human or animal subject.

23. The method of claim 21 comprising using said visible image for a dental diagnosis.

24. A method for forming a visible image comprising:

A) imagewise exposing the photothermographic material of claim 18 to X-radiation to form a latent image, and B) simultaneously or sequentially, heating said exposed photothermographic material to develop said latent image into a visible image.

* * * * *